US011057708B2

(12) United States Patent
Cheng et al.

(10) Patent No.: US 11,057,708 B2
(45) Date of Patent: Jul. 6, 2021

(54) DIAPHRAGM FOR A MICRO LOUDSPEAKER

(71) Applicant: CONCRAFT HOLDING CO., LTD., Grand Cayman (KY)

(72) Inventors: Lei Cheng, Kunshan (CN); Yankui Zhuang, Kunshan (CN); Tzu-Ching Tsai, New Taipei (TW)

(73) Assignee: CONCRAFT HOLDING CO., LTD., Grand Cayman (KY)

( * ) Notice: Subject to any disclaimer, the term of this patent is extended or adjusted under 35 U.S.C. 154(b) by 8 days.

(21) Appl. No.: 16/731,613

(22) Filed: Dec. 31, 2019

(65) Prior Publication Data

US 2021/0136497 A1 May 6, 2021

(30) Foreign Application Priority Data

Nov. 1, 2019 (TW) ..... 108214603

(51) Int. Cl.

| | |
|---|---|
| ***H04R 7/00*** | (2006.01) |
| ***H04R 9/02*** | (2006.01) |
| ***H04R 9/06*** | (2006.01) |
| ***H04R 7/12*** | (2006.01) |
| ***H04R 7/18*** | (2006.01) |

(52) U.S. Cl.

CPC ..... *H04R 7/12* (2013.01); *H04R 7/18* (2013.01); *H04R 9/02* (2013.01); *H04R 9/025* (2013.01); *H04R 9/06* (2013.01)

(58) Field of Classification Search

CPC . H04R 7/00; H04R 7/04; H04R 7/045; H04R 7/12; H04R 7/127; H04R 7/18; H04R 7/22; H04R 9/00; H04R 9/02; H04R 9/025; H04R 9/041; H04R 9/043; H04R 9/045; H04R 9/047; H04R 9/048; H04R 9/06; H04R 1/00; H04R 1/02; H04R 19/02; H04R 31/003; H04R 2400/07; H04R 2400/11

See application file for complete search history.

(56) References Cited

U.S. PATENT DOCUMENTS 7,961,902 B2 * 6/2011 Horigome ..... H04R 1/22 381/421
8,391,515 B2 * 3/2013 Lu ..... H04R 19/02 381/150

(Continued)

FOREIGN PATENT DOCUMENTS

KR 100541561 B1 * 1/2006
KR 100691746 B1 * 3/2007

*Primary Examiner* — Thang V Tran

(74) *Attorney, Agent, or Firm* — Muncy, Geissler, Olds & Lowe, P.C

(57) ABSTRACT

A diaphragm for a micro loudspeaker includes an outer casing that is provided with a through-hole, a membrane that is disposed in the through-hole, and a suspension that connects the membrane and the outer casing. The outer casing is provided with an inner wall that wraps into the through-hole. The suspension includes an effective operation zone that is extended from the inner wall into the through-hole, and a fixed area that is extended from the inner wall to outside the through-hole. The fixed area of the suspension is provided with a cut-off area, which keeps the effective operation zone at a good intactness, and enables the membrane to vibrate up and down more uniformly, thereby improving the sound quality of micro loudspeaker.

10 Claims, 9 Drawing Sheets

(56) References Cited

U.S. PATENT DOCUMENTS

| | | | | |
|---|---|---|---|---|
| 2011/0170736 | A1* | 7/2011 | Li | H04R 9/06 381/401 |
| 2011/0274308 | A1* | 11/2011 | Doh | H04R 9/06 381/398 |
| 2015/0181341 | A1* | 6/2015 | Azmi | H04R 1/24 381/398 |
| 2018/0376248 | A1* | 12/2018 | Yuen | H04R 7/127 |
| 2020/0053474 | A1* | 2/2020 | Nicoletti | H04R 7/14 |

* cited by examiner

DIAPHRAGM FOR A MICRO LOUDSPEAKER

BACKGROUND OF THE INVENTION a) Field of the Invention

The present invention relates to a diaphragm, and more particularly to a diaphragm for a micro loudspeaker, which keeps a suspension intact, thereby providing a better sound quality.

b) Description of the Prior Art

A micro loudspeaker is used primarily for electroacoustic transduction where electricity drives a coil to vibrate a magnet up and down, in order to drive a membrane to swing up and down in the speaker, and thereby generates sound to achieve the effect of electroacoustic transduction.

As the minimization of a wireless earphone, the size of a micro loudspeaker is also limited. An existing membrane used in the micro loudspeaker is connected to an outer casing primarily through a suspension; whereas, an ordinary membrane is formed directly by stamping a metal, and the suspension is formed by injection molding.

After the formation of conventional membrane and suspension, the membrane is adhered on the suspension, and the suspension is then adhered on the outer casing, enabling the membrane to vibrate up and down in the outer casing through the suspension. However, for the conventional micro loudspeaker, as the areas of membrane and suspension are relatively small, the area for adhering is limited, which easily results in ablation of the membrane and the suspension under a long time of usage, thereby affecting the sound quality of micro loudspeaker.

In the current market, it is also available that the suspension is directly formed on the membrane by injection molding, and after the suspension is formed integrally with the membrane, the suspension is then adhered on the outer casing. This method can improve the stability between the suspension and the membrane. However, as the suspension is still adhered on the outer casing, it can still easily cause the ablation of the suspension due to the instability in adhesiveness between the suspension and the outer casing.

For another kind of diaphragm, the suspension is formed directly between the outer casing and the membrane by injection molding. This kind of diaphragm can ensure the bondability among the outer casing, the membrane and the suspension to reduce the ablation among the three significantly. However, as the downsizing of micro loudspeaker, in this kind of method of utilizing the injection molding, the outer casing and the membrane should be pre-emplaced in a mold, and a forming space in a same shape as that of the suspension will be formed in the mold. After a forming material enters into the forming space via a gate of the mold, the suspension can be formed after the forming material is cooled down. However, in the current technology, the gate is disposed in an effective operation zone (a zone at an inner edge from the suspension to the outer casing for the membrane to vibrate up and down) of the suspension. Therefore, when the gate is disposed in the effective operation zone, a cut-off operation should be executed at the location between the suspension and the gate, after the suspension is accomplished with the injection molding. This will cut off the location between the suspension and the gate to form a cut-off area, which is generated at the gate, in the effective operation zone of the suspension. Accordingly, the effective operation zone of the suspension will be incomplete, which enables the membrane to vibrate up and down non-uniformly, and thereby affects the sound quality of micro loudspeaker.

Accordingly, how to provide a diaphragm, which keeps the effective operation zone of the suspension intact and enables the membrane to vibrate more uniformly, is the technical means to be solved by the present invention and the objects thereof.

SUMMARY OF THE INVENTION

The primary object of the present invention is to provide a diaphragm, and more particularly to a diaphragm for a micro loudspeaker to keep the effective operation zone of the suspension intact, thereby providing a better sound quality.

To achieve the abovementioned object, the present invention discloses a diaphragm for a micro loudspeaker, comprising an outer casing, a membrane and a suspension. A center of the outer casing is provided with a through-hole, and the outer casing is provided with an inner wall, an outer wall, and two end surfaces which are extended on an end edge of the inner wall and the outer wall, respectively. The wrapping of inner wall forms the through-hole, and the membrane is disposed in the through-hole. The suspension is provided with an effective operation zone that is extended from the inner wall into the through-hole and is connected on the membrane, as well as a fixed area that is extended from the inner wall toward the outer wall. In addition, a cut-off area is formed on the fixed area, keeping a good intactness of the effective operation zone of the suspension, in order to improve the sound quality of micro loudspeaker.

In accordance with an embodiment of the present invention, an interior of the effective operation zone of the suspension is formed with a drum part. The drum part is in an arc-shape and surrounds the membrane.

In accordance with an embodiment of the present invention, the drum part is roughly in an S-shape in the effective operation zone.

In accordance with an embodiment of the present invention, the outer casing is formed at least with a forming slot that is extended from the inner wall toward the outer wall, and the fixed area is disposed in the forming slot.

In accordance with an embodiment of the present invention, the forming slot is extended to one end surface, and the cut-off area is exposed on that end surface.

In accordance with an embodiment of the present invention, the forming slot penetrates the inner wall and the outer wall, and the cut-off area is exposed on the outer wall.

In accordance with an embodiment of the present invention, the outer casing is further provided with a first protruded part that is extended from the inner wall toward the center of through-hole, and the inner diameter of first protruded part is smaller than the inner diameter of inner wall.

In accordance with an embodiment of the present invention, the outer casing is further provided with plural second protruded parts that are extended from the first protruded part toward the center of through-hole. The inner diameter of each second protruded part is smaller than the inner diameter of first protruded part, and the second protruded parts are intermittently disposed on the first protruded part.

In accordance with an embodiment of the present invention, the outer casing is further provided with plural indented parts that are extended from the inner wall toward the outer wall, and the indented parts are disposed intermittently on the inner wall; whereas, every second protruded part and every indented part are disposed intermittently with respect to each other.

In accordance with an embodiment of the present invention, the first protruded part and the second protruded parts are disposed on the inner wall, and are in adjacent to one end surface.

In comparison with the prior art, the membrane of the present invention is provided with following advantage that:

1. Through disposing the cut-off area on the fixed area, the intactness of the effective operation zone can be kept, and the membrane can vibrate up and down more uniformly to improve the sound quality of micro loudspeaker.
2. Through the design of the first protruded part, second protrude parts and indented parts, the suspension can be extended into the first protruded part, second protruded parts and indented parts after accomplishing the injection molding, thereby enabling the suspension to be fixed on the outer casing more stably.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
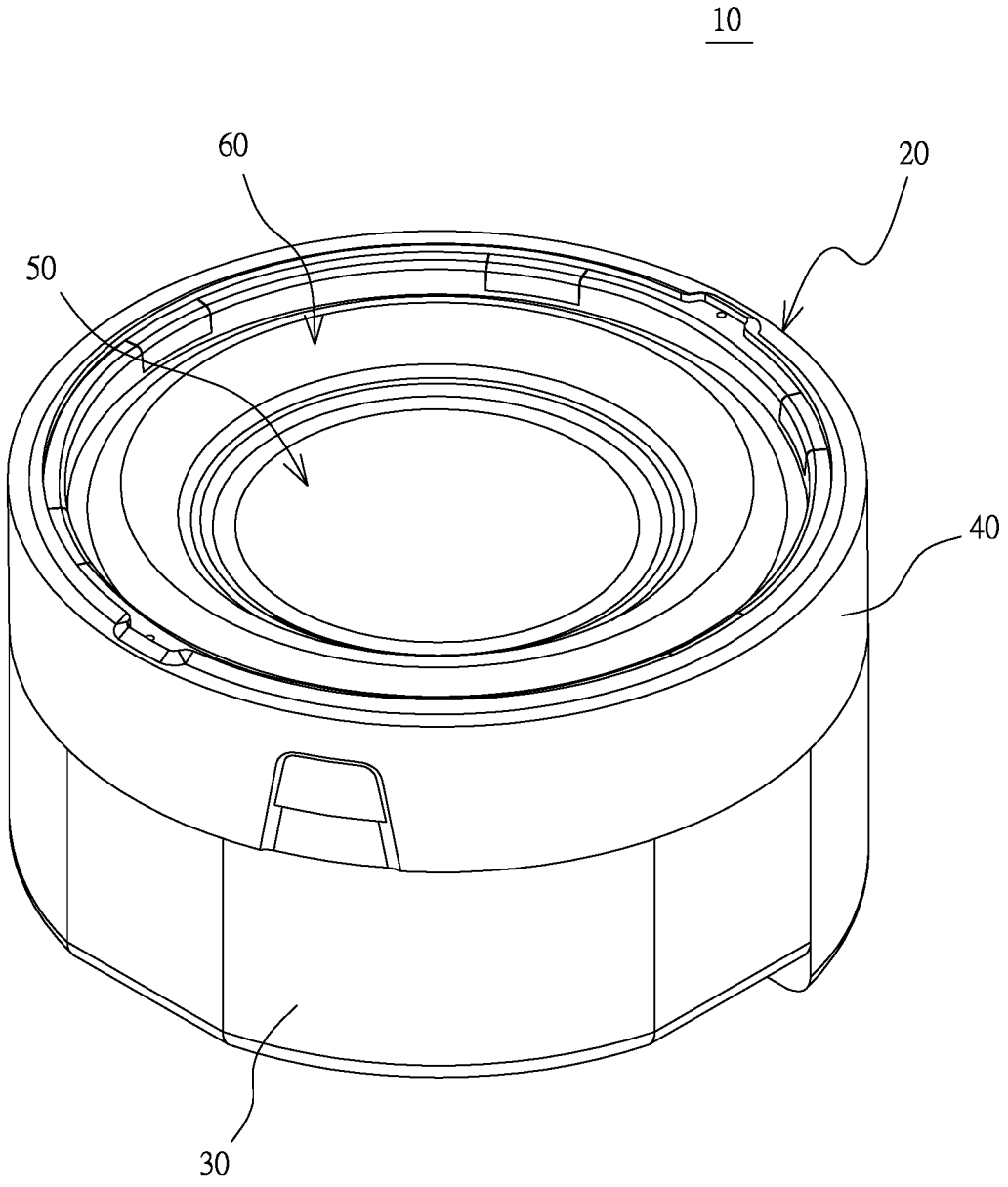
FIG. 1 shows a schematic view of the present invention that is applied to a micro loudspeaker.
Figure 2:
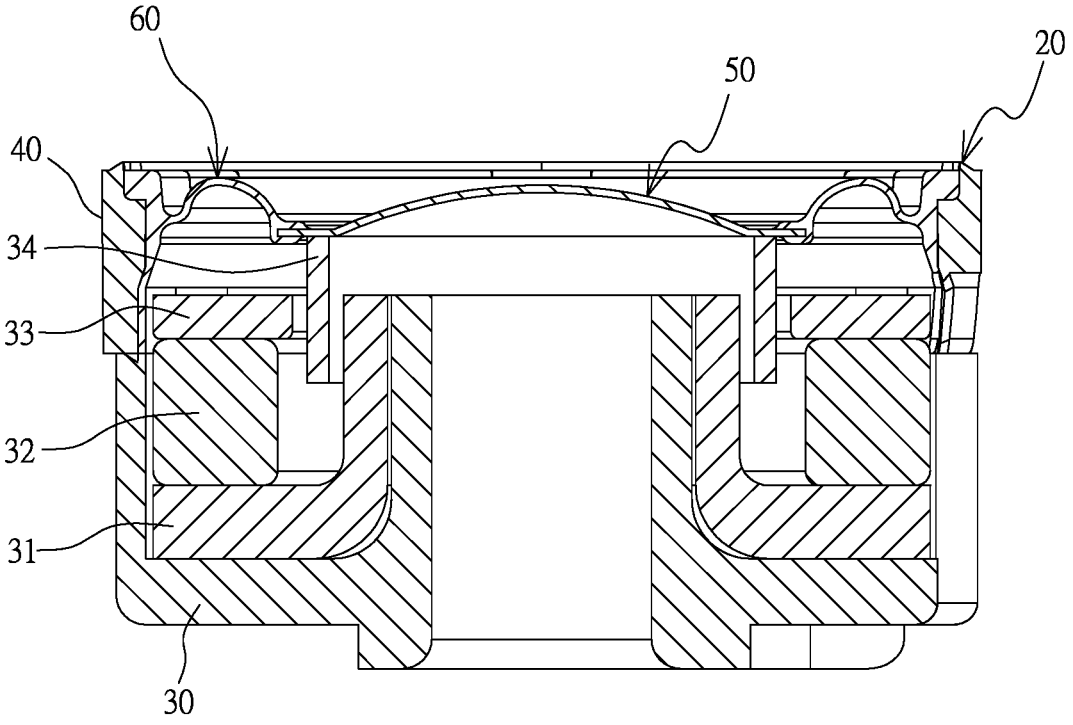
FIG. 2 shows a cutaway view of the present invention that is applied to the micro loudspeaker.
Figure 3:
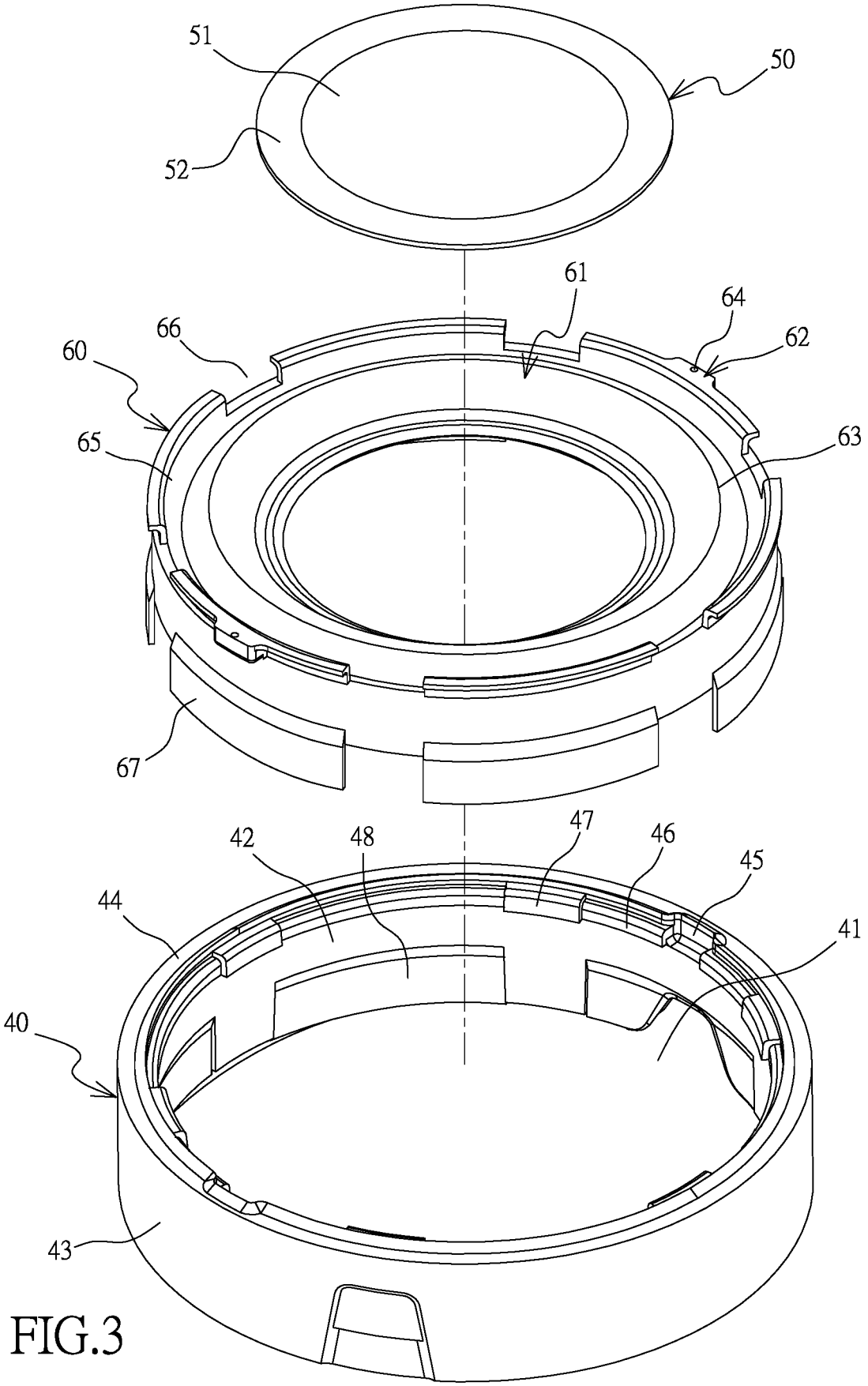
FIG. 3 shows an exploded view of a first form of implementation, according to the present invention.
Figure 4:
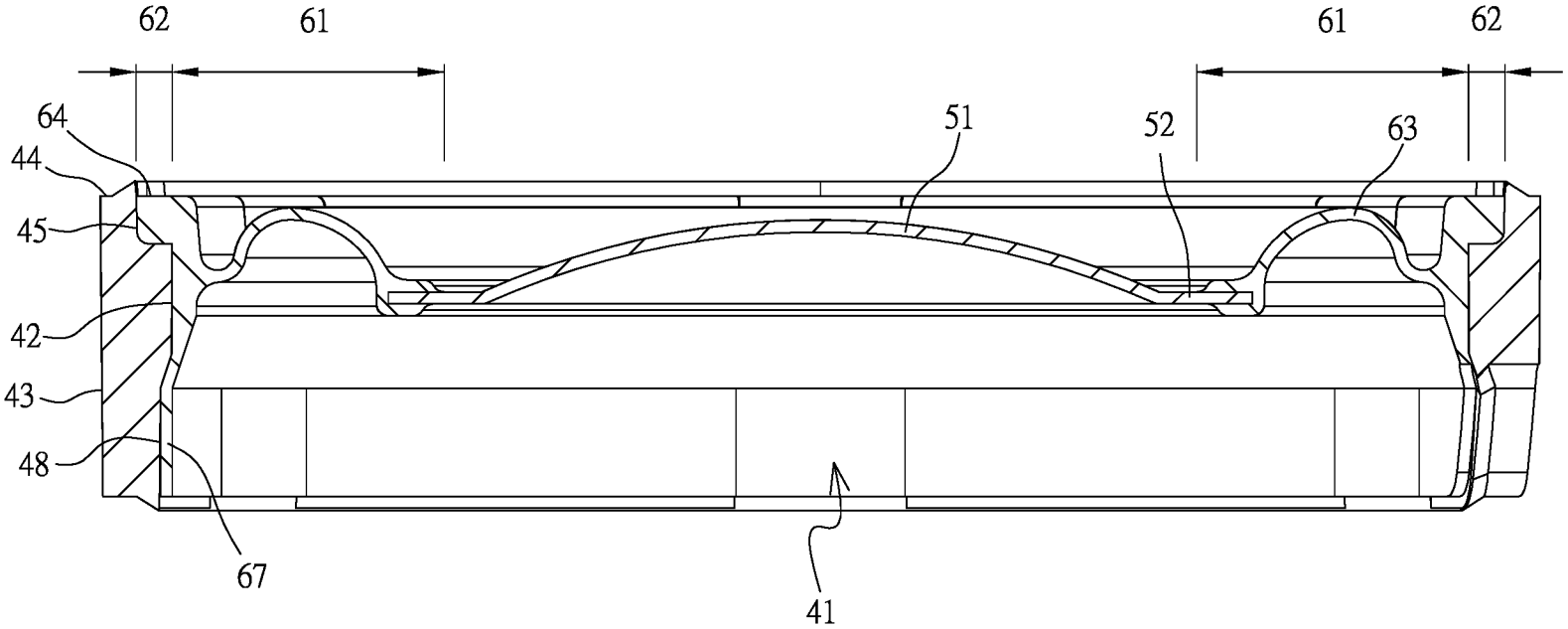
FIG. 4 shows a cutaway view at a viewing angle of the first form of implementation, according to the present invention.
Figure 5:
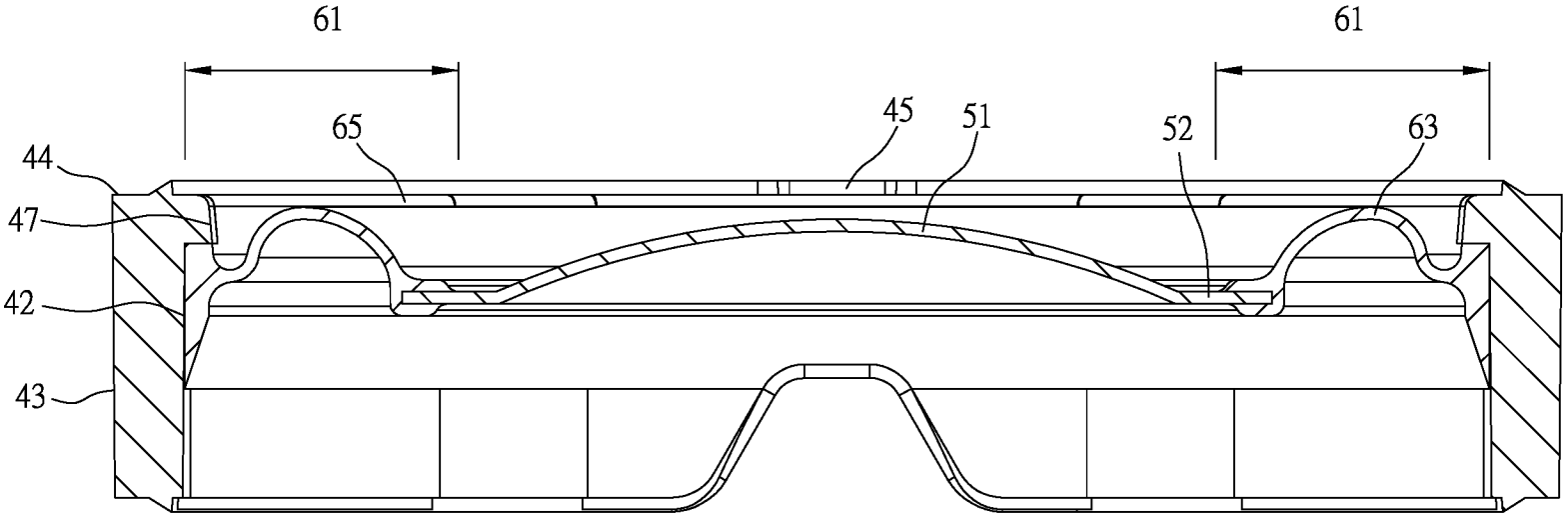
FIG. 5 shows a cutaway view at another viewing angle of the first form of implementation, according to the present invention.
Figure 6:
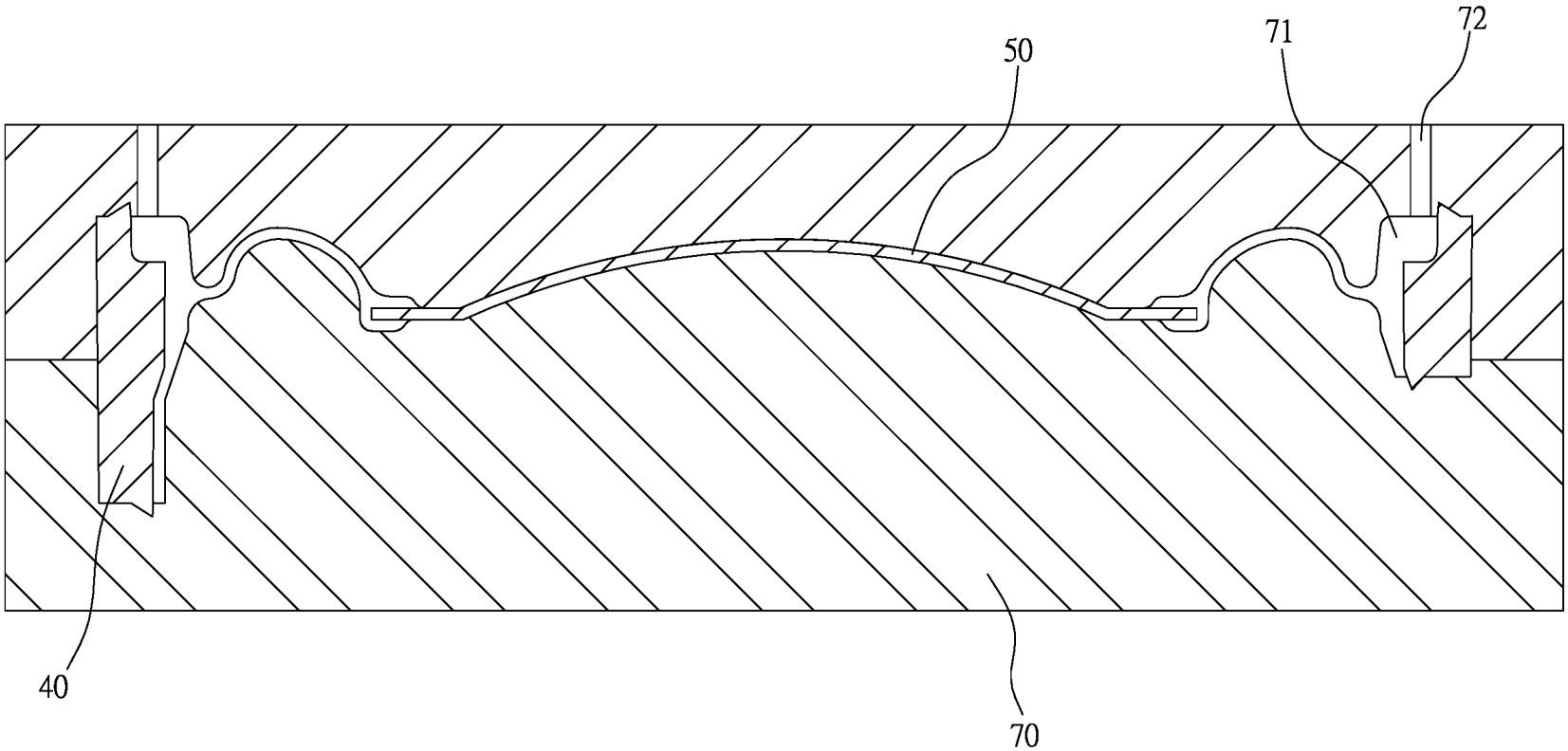
FIG. 6 shows a cutaway view at a viewing angle of the present invention, wherein a suspension is formed by injection molding in a mold.
Figure 7:
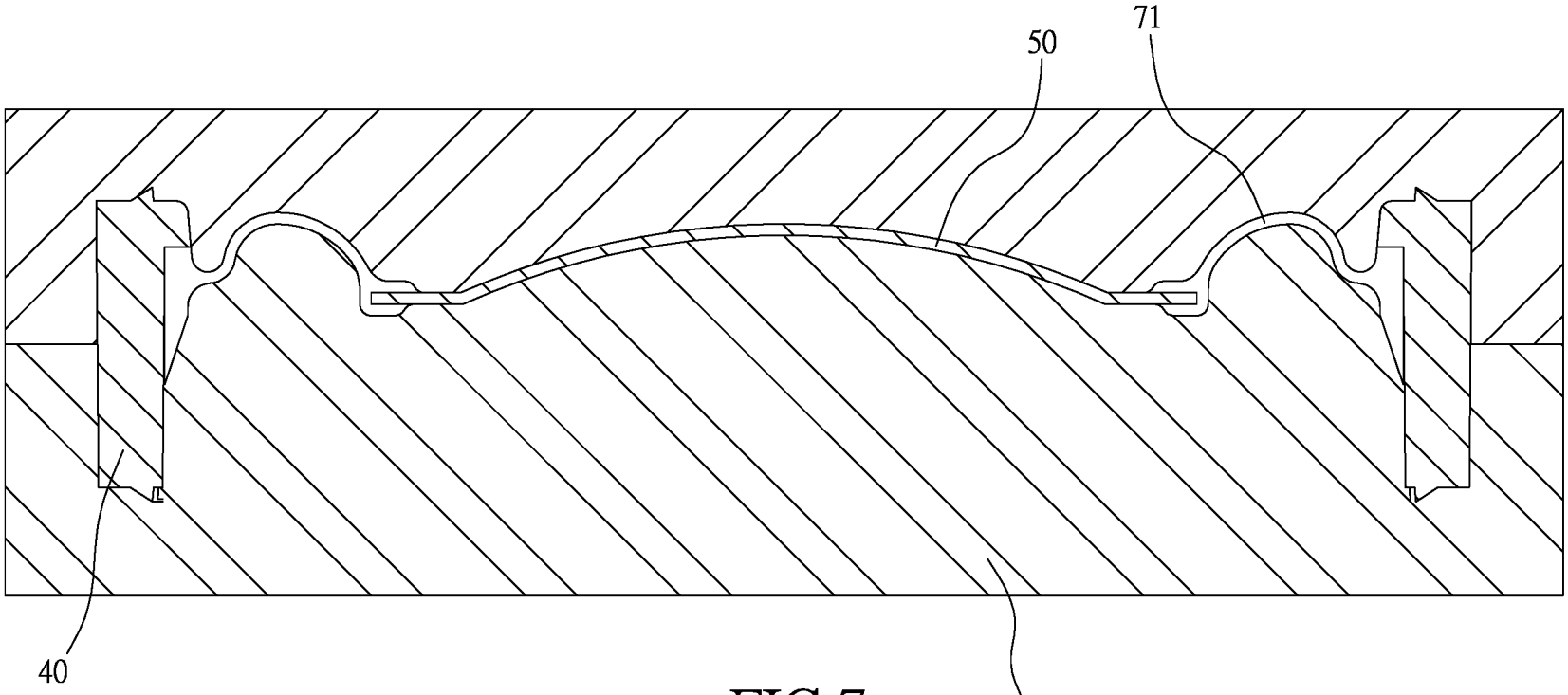
FIG. 7 shows a cutaway view at another viewing angle of the present invention, wherein the suspension is formed by injection molding in a mold.

Referring to FIGS. 1 to 7, it shows a first form of implementation of the present invention. The present invention discloses a diaphragm 20 that is applied to a micro loudspeaker 10. The micro loudspeaker 10 is constituted by a main body 30, a yoke 31 which is disposed in the main body 30, a magnet 32, a spring washer 33, and a voice coil 34 containing a coil (not shown on the drawings). The diaphragm 20 is installed above the main body 30 and can be used to fix the voice coil 34. The diaphragm 20 includes an outer casing 40 to be installed above the main body 30, a membrane 50 for fixing the voice coil 34, and a suspension 60 for connecting the outer casing 40 and the membrane 50.

A center of the outer casing 40 is provided with a through-hole 41. The outer casing 40 is constituted by an inner wall 42 that wraps into the through-hole 41, an outer wall 43 that is opposite to the inner wall 42, and two end surfaces 44 that are connected on an end edge of the inner wall 42 and the outer wall 43, respectively. In addition, the outer casing 40 is also provided with at least a forming slot 45 that is extended from the inner wall 42 toward the outer wall 43, at least a first protruded part 46 that is extended from the inner wall 42 toward the through-hole 41, plural second protruded parts 47 that are extended from the first protruded part 46 toward the through-hole 41, and plural indented parts 48 that are extended from the inner wall 42 toward the outer wall 43. In the present embodiment, the forming slot 45 is extended to one end surface 44 of the outer casing 40, and the first protruded part 46 surrounds the inner wall 42, with that the inner diameter of first protruded part 46 is smaller than the inner diameter of inner wall 42. The second protruded parts 47 are intermittently disposed on the first protruded part 46, and the inner diameter formed by the second protruded parts 47 is smaller than the inner diameter of first protruded part 46. The indented parts 48 are disposed below the first protruded part 46, opposite to the other end surface 44 of the outer casing 40.

A center of the membrane 50 is formed with a bump part 51, and the periphery of bump part 51 is surrounded by a connecting part 52.

The suspension 60 is provided with an effective operation zone 61 that is extended from the inner wall 42 of the outer casing 40 toward the connecting part 52 of the membrane 50, and a fixed area 62 that is extended from the inner wall 42 toward the outer wall 43. An interior of the effective operation zone 61 is provided with a drum part 63 that is roughly in an S-shape. In the present embodiment, the fixed area 62 is extended from the effective operation zone 61 into the forming slot 45, and above the fixed area 62 is a cut-off area 64 that is exposed on the end surface 44 of the outer casing 40. The suspension 60 is provided with at least a first connecting part 65, plural second connecting parts 66 and plural third connecting parts 67 to be latched with the first protruded part 46, the second protruded parts 47 and the indented parts 48 respectively, on the locations corresponding to the first protruded part 46, the second protruded parts 47 and the indented parts 48. The first connecting part 65 surrounds the inner wall 42, and is latched with the first protruded part 46. The second connecting parts 66 are disposed intermittently, with each second connecting part 66 corresponding to one second protruded part 47 to be latched together. The third connecting parts 67 are disposed intermittently, with each third connecting part 67 corresponding to one indented part 48 to be latched together. The second connecting parts 66 and the third connecting parts 67 are disposed intermittently through the first connecting part 65, so that the suspension 60 can be connected effectively between the outer casing 40 and the membrane 50, and the membrane 50 can vibrate up and down in the through-hole 41 of the outer casing 40, through the effective operation zone 61 on the suspension 60.

In the present embodiment, the suspension 60 is formed between the outer casing 40 and the membrane 50 in a mold 70 by injection molding. In the forming method, the outer casing 40 and the membrane 50 are first emplaced in the mold 70, and the membrane 50 is put in the center of through-hole 41 of the outer casing 40. Next, a liquid form of silica gel is injected into a forming space 72 inside the mold 70 through at least a feed port 71 on the mold 70, which forms the suspension 60 when the silica gel is cooled down after the forming space 72 is filled up with the silica gel. It is worth mentioning that after the suspension 60 is cooled down and formed in the mold 70, as the feed port 71 is interconnected with the forming space 72, the location where the suspension 60 is connected with the feed port 71 should be cut off that the suspension 60 can escape from the mold 70. On the other hand, the cut-off area 64 will be formed on the suspension 60 after the location where the suspension 60 is connected with the feed port 71 is cut off. As the cut-off area 64 is disposed at the fixed area 62, the intactness of effective operation zone 61 can be kept, which makes the quality in the effective operation zone 61 uniform.

Accordingly, when the diaphragm 20 is installed on the main body 30, the voice coil 34 is disposed primarily below the membrane 50. When the micro loudspeaker 10 is energized, an excitation effect will be formed to the voice coil 34 through the magnet 32, allowing the voice coil 34 to undergo a back and forth movement along the axis of magnet 32 in the micro loudspeaker 10. As the voice coil 34 is connected primarily below the membrane 50, when the voice coil 34 is undergoing the back and forth movement, it will drive the membrane 50 to vibrate up and down, thereby achieving the electroacoustic transduction effect. When the membrane 50 is vibrating up and down, it operates in the through-hole 41 of the outer casing 40 through the suspension 60, and vibrates up and down by the effective operation zone 61 of the suspension 60. Therefore, by the intactness of effective operation zone 61, the membrane 50 can operate uniformly without causing deflection, thereby improving the sound quality of micro loudspeaker 10 effectively.

Figure 8:
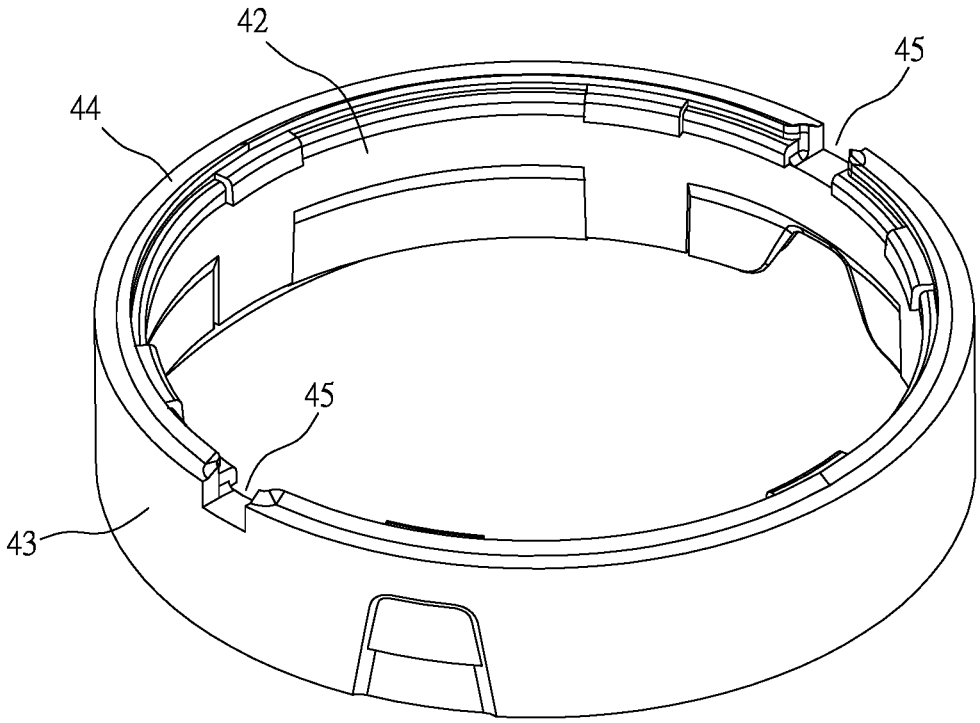
FIG. 8 shows a schematic view of a second form of implementation of an outer casing, according to the present invention.
Figure 9:
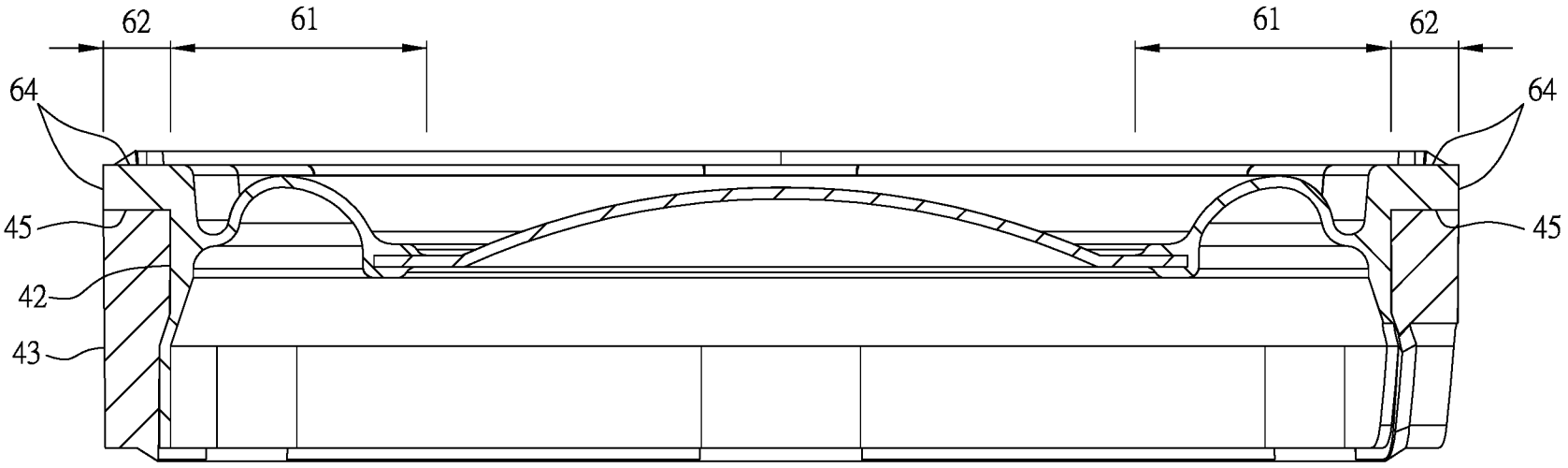
FIG. 9 shows a cutaway view at a viewing angle of the second form of implementation, according to the present invention.

Furthermore, as shown in FIG. 8 and FIG. 9, in the present embodiment, the forming slot 45 penetrates primarily from the inner wall 42 to the outer wall 43 to increase the depth of forming slot 45, so that the fixed area 62 can be extended into the forming slot 45 and exposed on the outer wall 43. Therefore, the adhesive force between the suspension 60 and the outer casing 40 can be increased, and the design space of the cut-off area 64 can be larger. In addition to that the cut-off area 64 can be disposed on the end surface 44, the cut-off area 64 can be also disposed on the outer wall 43, which similarly keeps the intactness of effective operation zone 61.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A diaphragm for a micro loudspeaker, comprising an outer casing, a center of which is provided with a through-hole, with the outer casing being provided with an inner wall, an outer wall, and two end surfaces that are extended on an end edge of the inner wall and the outer wall respectively, whereas the through-hole being formed by the wrapping of the inner wall;

a membrane that is disposed in the through-hole; and a suspension that is connected to the outer casing and the membrane, with the suspension being provided with an effective operation zone that is extended from the inner wall into the through-hole and is connected on the membrane, and a fixed area that is extended from the inner wall toward the outer wall, and is formed with a cut-off area to keep the effective operation zone of the suspension at a good intactness.

2. The diaphragm for a micro loudspeaker, according to claim 1, wherein an interior of the effective operation zone of the suspension is formed with a drum part, with the drum part being in an arc-shape and surrounding the membrane.

3. The diaphragm for a micro loudspeaker, according to claim 2, wherein the drum part is roughly in an S-shape in the effective operation zone.

4. The diaphragm for a micro loudspeaker, according to claim 1, wherein the outer casing is formed with a forming slot from the inner wall toward the outer wall, and the fixed area is disposed in the forming slot.

5. The diaphragm for a micro loudspeaker, according to claim 4, wherein the forming slot is extended to one end surface, and the cut-off area is exposed on the end surface.

6. The diaphragm for a micro loudspeaker, according to claim 4, wherein the forming slot penetrates the inner wall and the outer wall, and the cut-off area is exposed on the outer wall.

7. The diaphragm for a micro loudspeaker, according to claim 1, wherein the outer casing is further provided with a first protruded part that is extended from the inner wall toward the through-hole, and the inner diameter of first protruded part is smaller than the inner diameter of inner wall.

8. The diaphragm for a micro loudspeaker, according to claim 7, wherein the outer casing is further provided with plural second protruded parts that are extended from the first protruded part toward the through-hole, the inner diameter of second protruded parts is smaller than the inner diameter of first protruded part, and the second protruded parts are disposed intermittently on the first protruded part.

9. The diaphragm for a micro loudspeaker, according to claim 8, wherein the outer casing is further provided with plural indented parts that are extended from the inner wall toward the outer wall, and the indented parts are disposed intermittently on the inner wall, whereas every second protruded part and every indented part are disposed intermittently with respect to each other.

10. The diaphragm for a micro loudspeaker, according to claim 9, wherein the first protruded part and the second protruded parts are disposed on the inner wall, in adjacent to one end surface.

* * * * *